US010339903B2

(12) United States Patent
Floyd

(10) Patent No.: US 10,339,903 B2
(45) Date of Patent: Jul. 2, 2019

(54) STOMP BOX PERCUSSION DEVICE

(71) Applicant: Cynthia A. Floyd, Nashville, TN (US)

(72) Inventor: Cynthia A. Floyd, Nashville, TN (US)

( * ) Notice: Subject to any disclaimer, the term of this patent is extended or adjusted under 35 U.S.C. 154(b) by 0 days.

(21) Appl. No.: 16/153,885

(22) Filed: Oct. 8, 2018

(65) Prior Publication Data

US 2019/0139520 A1 May 9, 2019

Related U.S. Application Data

(60) Provisional application No. 62/583,159, filed on Nov. 8, 2017.

(51) Int. Cl.
*G10D 13/02* (2006.01)
*G10H 3/14* (2006.01)

(52) U.S. Cl.
CPC ..... *G10D 13/02* (2013.01); *G10H 3/146* (2013.01); *G10H 2220/525* (2013.01)

(58) Field of Classification Search
CPC ..... G10D 13/02
See application file for complete search history.

(56) References Cited

U.S. PATENT DOCUMENTS 9,263,019 B2 * 2/2016 Dahl ..... G10H 3/143
9,711,122 B1 7/2017 Pelt
10,163,427 B1 * 12/2018 Sutherland ..... G10D 13/025
2015/0187344 A1 * 7/2015 James ..... F21V 33/0056 84/411 R
2016/0140940 A1 * 5/2016 Sprengel ..... G10D 7/00 84/170

FOREIGN PATENT DOCUMENTS

DE 202013010976 U1 2/2014

OTHER PUBLICATIONS

Website available at least as early as Jan. 25, 2019 at: https://www.peterman.com.au/music3/Acoustic_stompbox/StompDaFloorVarious Stomp Boxes.
Website available at least as early as Jan. 25, 2019 at: https://derringers.com.au/wild-dog-slomp-box-dingoVarious Stomp Boxes.
Website available at least as early as Jan. 25, 2019 at: https://www.amazon.com/SX-SBX-II-Stomp-Box/dp/B004CG2V288Stomp Box.

* cited by examiner

*Primary Examiner* — Robert W Horn
(74) *Attorney, Agent, or Firm* — PatentFile, LLC; Bradley C. Fach; Steven R. Kick

(57) ABSTRACT

A stomp box percussion device may include a top plate having an exterior surface and an opposing interior surface. One or more sidewalls may be coupled to the interior surface, and a chamber may be formed by the interior surface and the one or more sidewalls. Preferably, a sound device may be disposed in the chamber. A central kerf may be disposed on the exterior surface of the top plate, and one or more alternating kerfs may be disposed on the interior surface of the top plate. The top plate may support the weight of a performer, while the performer's alternating or inactive (supporting) foot may not dampen the resonance of the top plate when he/she is standing on and playing the device with their active (stomping or tapping) foot.

20 Claims, 7 Drawing Sheets

STOMP BOX PERCUSSION DEVICE

CROSS REFERENCE TO RELATED APPLICATIONS

This application claims priority to and the benefit of the filing date of U.S. Provisional Application No. 62/583,159, filed on Nov. 8, 2017, entitled "STOMP BOX PERCUSSION DEVICE", which is hereby incorporated by reference in its entirety.

FIELD OF THE INVENTION

This patent specification relates to the field of percussion instruments and devices. More specifically, this patent specification relates to a stomp box percussion device that is able to produce a variety of sounds, which is portable in nature, and able to easily interface into a performance space.

BACKGROUND

It is common for a solo artist or small performing group or band to desire to add the rhythmical sound of a bass drum to their musical performance while playing an instrument such as a guitar or keyboard. Often these musicians will incorporate a stomp box into their performance. A stomp box or stompbox is a simple percussion instrument consisting of a box placed under the foot, which is tapped or stamped on rhythmically to produce a sound similar to that of a bass drum. A stomp box allows a performer such as a singer or guitar player to create a simple rhythmic self-accompaniment. Unfortunately, currently available stomp boxes often do not produce the deep frequency sound of a bass drum that is desired by the performer. These stomp boxes also are unable to provide a surface which allows for a natural motion of generating the sound without hindering the playing of the performer's main instrument.

Therefore, a need exists for novel stomp box percussion devices. There is also a need for novel stomp box percussion devices which are able to provide a percussion device that can be easily implemented by a performer. A further need exists for novel stomp box percussion devices which are able to produce desired bass drum sounds in addition to other percussion embellishment sounds. Finally, a need exists for novel stomp box percussion devices that are portable in nature and able to easily interface into the performance space of a musician.

BRIEF SUMMARY OF THE INVENTION

A stomp box percussion device is provided which preferably may be called the Sole Stomp Box. The device is configured to closely match the low frequency sound of an actual bass drum, and is designed to allow the musician to comfortably stand with both feet on the device in a natural performance position, and while stomping with one foot, eliminate the natural dampening of the stationary foot that remains planted on the top of the device. Preferably, the device may be configured to offer a sizeable and stable platform designed to allow the musician to stand and move comfortably on the device in accordance with their normal live performance, and may be configured to allow for the musician's natural and normal rhythmical action of either or both feet without undue strain thereby enabling the device to be played for long periods of time. Additionally, the device is simple, easily transportable, and easily implemented into the venue set-up to provide a high quality non-prerecorded bass drum sound (along with other percussion embellishment sounds) into the musician's live performance.

In some embodiments, the stomp box percussion device may include a top plate having an exterior surface and an opposing interior surface. One or more sidewalls may be coupled to the interior surface, and a chamber may be formed by the interior surface and the one or more sidewalls. Preferably, a sound device may be disposed in the chamber. A central kerf may be disposed on the exterior surface of the top plate, and one or more alternating kerfs may be disposed on the interior surface of the top plate.

In further embodiments, the device may comprise a frame having a top plate, a bottom plate, and one or more sidewalls, which may connect the top plate and bottom plate. The frame may bound and form a generally rectangular prism shaped chamber. A sound device may be disposed in the chamber, and optionally a central aperture may pass through a sidewall of the frame to facilitate the communication of sound out of the chamber. Optionally, the sound device may be in communication with an audio connector. A central kerf may be centrally disposed on the exterior surface of the top plate, and optionally one or more alternating kerfs may be disposed on the interior surface of the top plate. The top plate may support the weight of a performer, while the performer's alternating or inactive (supporting) foot may not dampen the resonance of the top plate when he/she is standing on and playing the device with their active (stomping or tapping) foot.

In further preferred embodiments, the device provides a solid platform of a standard shape for a musician to stand on in a comfortable, natural position with both feet on the top plate and stomp or tap either foot to generate a bass or kick drum sound. The device is basically a stage on a stage for the performer. The top plate may comprise a central kerf that prevents the alternating or inactive (supporting) foot of the musician from dampening the effect of the stomping foot. Alternating kerfs, optionally positioned randomly, on the underside of the top plate further increase resonance, while a central aperture in the frame matches the frequency of the top plate with the air in the chamber, causing the air in the central aperture to act like a mass, and the air in the chamber will act like a spring, producing a louder and deeper sound.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
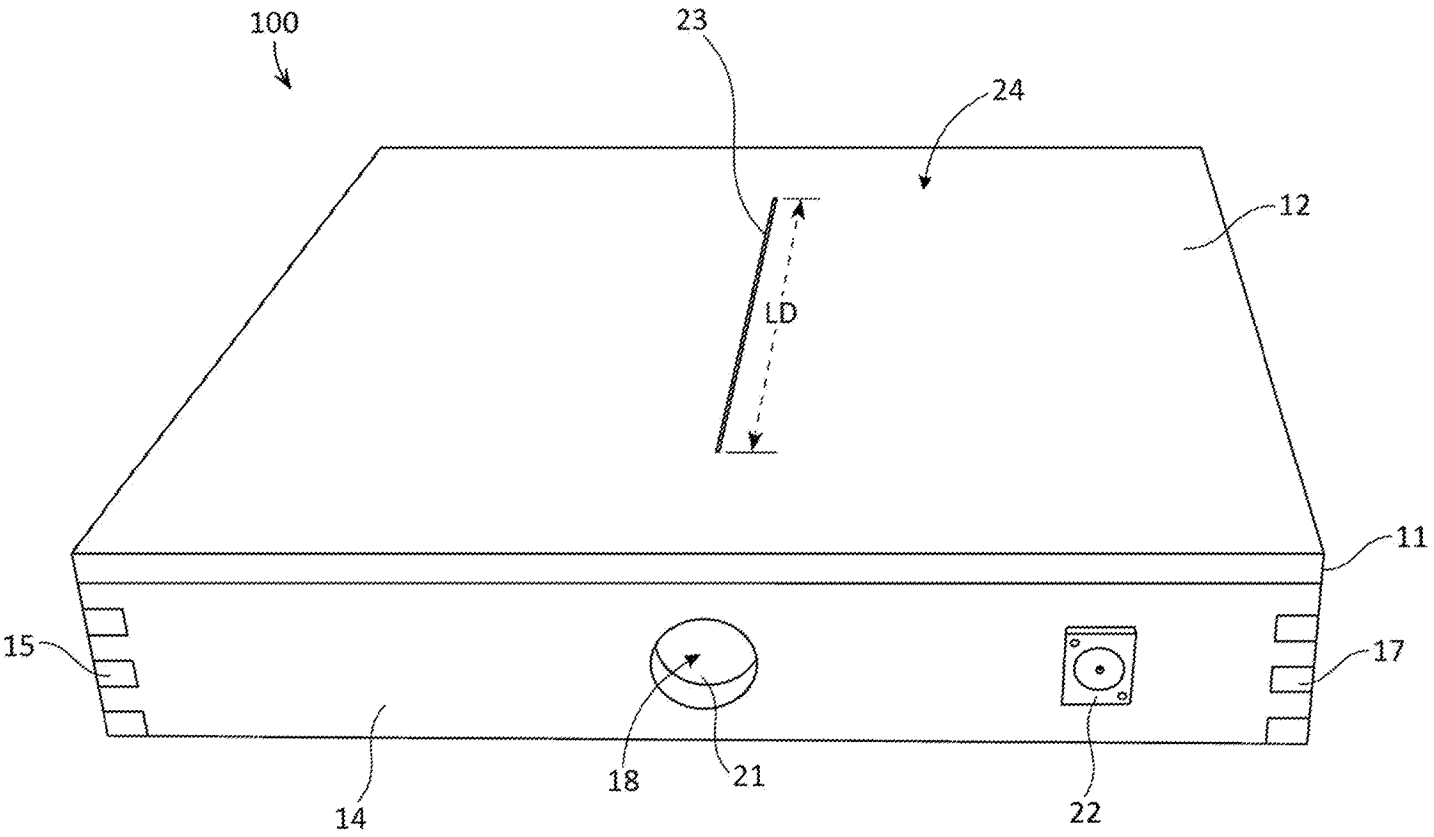
FIG. 1 depicts a top perspective view of an example of a stomp box percussion device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts of the invention. Hence, specific dimensions and other physical characteristics relating to the embodiments disclosed herein are not to be considered as limiting, unless expressly stated otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new stomp box percussion instrument device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of a stomp box percussion device ("the device") 100 according to various embodiments. In some embodiments, the device 100 may comprise a top plate 12 having an exterior surface 24 and an opposing interior surface 26. One or more sidewalls 14, 15, 16, 17, may be coupled to the interior surface 26, and a chamber 18 may be formed by the interior surface 26 and the one or more sidewalls 14, 15, 16, 17. Preferably, a sound device 19 may be disposed in the chamber 18. A central kerf 23 may extend through the top plate 12, and one or more alternating kerfs 25 may be disposed on the interior surface 26 of the top plate 12.

In preferred embodiments, the device 100 may comprise a frame 11 having a top plate 12, a bottom plate 13, and one or more sidewalls 14, 15, 16, 17, which may connect the top plate 12 and bottom plate 13. The frame 11 may bound and form a generally rectangular prism shaped chamber 18. A sound device 19 may be disposed in the chamber 18, and a central aperture 21 may pass through a sidewall 14, 15, 16, 17, of the frame 11 to facilitate the communication of sound out of the chamber 18. The sound device 19 may be in communication with an audio connector 22. A central kerf 23 may be centrally disposed on the top plate 12, and one or more alternating kerfs 25 may be disposed on the interior surface 26 of the top plate 12. The top plate 12 may support the weight of a performer, while the performer's alternating or inactive (supporting) foot may not dampen the resonance of the top plate 12 when he/she is standing on and playing the device 100 with their active (stomping or tapping) foot.

In some embodiments, a frame 11 may be formed by one or more, such as four, generally rectangular shaped sidewalls 14, 15, 16, 17, a generally square shaped top plate 12, and a generally square shaped bottom plate 13. The top plate 12 and bottom plate 13 may be generally parallel and opposingly positioned to each other, and the top plate 12 and bottom plate 13 may each be coupled, approximately perpendicularly, to the sidewalls 14, 15, 16, 17. Each sidewall 14, 15, 16, 17, may be approximately coupled perpendicularly to two other sidewalls 14, 15, 16, 17, to preferably form a generally rectangular prism shaped container which may define a generally rectangular prism shaped chamber 18. In other embodiments, the sidewalls 14, 15, 16, 17, a top plate 12, a bottom plate 13, or any other element of the device 100 disclosed herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention. For example, the device 100 may comprise a generally circular shaped top plate 12, optionally a generally circular shaped bottom plate 13, and an annular shaped first sidewall 13 that may be coupled together to form a generally cylindrical shaped chamber 18. As another example, the device 100 may comprise a generally triangular shaped top plate 12, optionally a generally triangular shaped bottom plate 13, and three sidewalls 13, 14, 15, that may be coupled together to form a generally triangular prism shaped chamber 18.

In some embodiments, the frame 11 may comprise four similarly dimensioned sidewalls 14, 15, 16, 17. In preferred embodiments, each sidewall 14, 15, 16, 17, may be approximately 3.5 inches wide and approximately 0.75 inches thick. In other embodiments, one or more sidewalls 14, 15, 16, 17, may be configured with any other dimensions which enable the sidewalls 14, 15, 16, 17, to provide structural support of the top plate 12 as well as influencing the volume of the device 100. In further embodiments, one or more sidewalls 14, 15, 16, 17, may be made from or comprise a wood material, such as solid poplar, maple, and/or any other choice of hardwood(s).

In alternative embodiments, one or more sidewalls 14, 15, 16, 17, may be made from or comprise any substantially rigid material, such as any other type of wood or plant based material, aluminum, steel, or other metal and metal alloys, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, or any other material including combinations of materials that are substantially rigid. In further preferred embodiments, the device 100 may include four sidewalls 14, 15, 16, 17, arranged into a square shape. The sidewalls 14, 15, 16, 17, may comprise one or more splines which may be used to join and couple the sidewalls 14, 15, 16, 17, together with an adhesive; although any other coupling method may be used.

The device 100 may include a bottom plate 13 which may be coupled to the lower portions of the sidewalls 14, 15, 16, 17. In preferred embodiments, the sidewalls 14, 15, 16, 17, may each be routed approximately 0.5 of an inch on the bottom edge of their respective inside faces so a generally rectangular planar shaped bottom plate 13 may be inset to complete the enclosure of the chamber 18. In some embodiments, the bottom plate 13 may be approximately 0.186 inches thick. It is noted a relatively thicker bottom plate 13, such as approximately 0.25 inches may be used, but a thicker bottom plate 13 will change the way that the device 100 resonates. A bottom plate 13 may be attached to the sidewalls 14, 15, 16, 17, with adhesive, fasteners, or any other suitable coupling method. Preferably, a bottom plate 13 may be generally planar in shape having a generally planar in shape bottom interior surface 33 and a generally planar in shape bottom exterior surface 34.

In preferred embodiments, the bottom plate 13 may be made from or comprise a different material than which is used to form all or portions of the sidewalls 14, 15, 16, 17, and top plate 12, such as a lauan plywood (also known as Philippine mahogany). Lauan plywood is preferable for the bottom plate 13 as it resonates at a lower frequency than birch plywood, producing a more resonant low and enhancing the tone of the sound. Additionally, lauan plywood is also a sustainable hardwood. In alternative embodiments, the bottom plate 13 may be made from or comprise any other type of wood, plant based material, or other material including combinations of materials that are substantially rigid.

The device 100 includes a top plate 12 which may comprise a generally planar exterior surface 24 upon which a user may stand or be supported. Preferably, a top plate 12 may be generally planar in shape having a generally planar in shape interior surface 26 and a generally planar in shape exterior surface 24. The top plate 12 may be coupled to the upper portions of the sidewalls 14, 15, 16, 17. In preferred embodiments, the top plate 12 may be approximately 0.5 inches thick to provide a sturdy platform to support the performing musician's full body weight and is durable enough for extended use. The top plate 12 may be coupled to the sidewalls 14, 15, 16, 17, with adhesive, fasteners, or any other suitable coupling method. Preferably, the sidewalls 14, 15, 16, 17, may be coupled to the interior surface 26 of the top plate 12.

In further preferred embodiments, the top plate 12 may be made from or comprise a different material than which is used to form all or portions of the sidewalls 14, 15, 16, 17, and bottom plate 13, such as Baltic birch plywood. Baltic birch plywood is preferable for the top plate 12, as it is stronger, produces a sharp attack when struck, and resonates at a lower frequency than other readily available plywood types having approximately a 0.5 inches thickness. Additionally, Baltic birch plywood is a durable and sustainable tone wood. For example, Baltic birch is preferred for good low-end punch, attack, and volume in drum shell composition. In alternative embodiments, the top plate 12 may be made from or comprise any other type of wood, plant based material, or other material including combinations of materials that are substantially rigid.

In some embodiments, the device 100 may comprise one or more support feet 27 which may be coupled to lower portions of the device 100 and which may support the device 100 above a surface. In some embodiments that do not include a bottom plate 13, one or more support feet 27 may be coupled to portions of one or more of the sidewalls 14, 15, 16, 17, that are distal to the top plate 12. In other embodiments, one or more support feet 27 may be coupled to the bottom exterior surface 34 of the bottom plate 13. In preferred embodiments, a support foot 27 may be coupled to a sidewall 14, 15, 16, 17, or bottom plate 13 proximate to or below the intersection of two sidewalls 14, 15, 16, 17, and/or a bottom plate 13. In further preferred embodiments, the support feet 27 may keep the device 100 set off of a floor surface to increase resonance and prevent movement of the device 100 on the floor. A support foot 27 may preferably be made from or comprise a flexible material, such as rubber, silicone, elastic plastics, elastic silicone, elastic rubbers, silicone rubbers, or any other generally flexible material.

In some embodiments, the device 100 may comprise one or more corner supports 28. In preferred embodiments, a corner support 28 may measure approximately 1.5 inch by 1.5 inch by 3 inches, although other dimensions may be used. In further preferred embodiments, a corner support 28 may be coupled to two sidewalls 14, 15, 16, 17, at each corner formed by two sidewalls 14, 15, 16, 17. In further embodiments, a corner support 28 may be coupled to the bottom plate 13, such as to the bottom interior surface 33, and also to two sidewalls 14, 15, 16, 17, at each corner formed by two sidewalls 14, 15, 16, 17. In some embodiments, the corner supports 28 may be offset or spaced approximately 0.1875 inches away, or any other distance, from the interior surface 26 of the top plate 12 so as to not touch the top plate 12 and inhibit the surface vibration and resulting sound production of the top plate 12.

In some embodiments, the device 100 may comprise one or more sound devices 19 which may be positioned within the chamber 18 and preferably coupled to the interior surface 26 of the top plate 12. In further embodiments, sound device 19 may be coupled generally centrally to the interior surface 26 of the top plate 12. A sound device 19 may be used to produce a plurality of sounds, preferably bass drum sounds, at a plurality of volume levels.

A sound device 19 may comprise a buzzer, a piezoelectric sound producing device, a dielectric elastomer sound producing device, a buzzer, a moving coil loudspeaker, an electrostatic loudspeaker, an isodynamic loudspeaker, a piezo-electric loudspeaker, or any other device capable of producing one or more sounds. In still further embodiments, a sound device 19 may comprise any device which may be capable of generating an electronic signal indicative of a bass drum or other percussion instrument in response to the exterior surface 24 of the top plate 12 being stomped, hit, struck, or otherwise impacted with a user's foot or other object. Optionally, the device 100 may comprise a dust screen 31 which may be disposed over portions of the sound device 19, such as over the speaker cone of a speaker-type sound device 19.

In some embodiments, the device 100 may comprise a pickup device 35 which may be coupled to an element of the device 100, such as to a top plate 12, sidewall sidewalls 14, 15, 16, 17, and/or bottom plate 13, and which may be used to convert vibrations into an electrical signal. In preferred embodiments, a pickup device 35 may be configured to generate other percussion sounds, such as a tambourine, bass drum, etc., in response to the foot of a musician or other object hitting the exterior surface 24 (playing surface) of the top plate 12. A pickup device 35 may comprise a magnetic pickup, a piezoelectric (piezo) pickup, or any other transducer that captures or senses mechanical vibrations and converts these to an electrical signal that is amplified using an instrument amplifier to produce musical sounds through a loudspeaker. In other embodiments, a pickup device 35 may comprise a microphone such as electromagnetic induction microphones (dynamic microphones), capacitance change microphones (condenser microphones), and piezoelectricity microphones (piezoelectric microphones) to produce an electrical signal from air pressure variations.

In some embodiments, the device 100 may optionally include a low-pass filter (LPF) 36 which may comprise a filter that passes signals with a frequency lower than a selected cutoff frequency and attenuates signals with frequencies higher than the cutoff frequency. Generally, a low-pass filter 36 may reduce the higher frequencies in the signal generated by a pickup device 35. A low-pass filter 36 is sometimes called a high-cut filter, or treble-cut filter in audio applications. Low-pass filters 36 exist in many different forms, including electronic circuits such as a hiss filter used in audio, anti-aliasing filters for conditioning signals prior to analog-to-digital conversion, digital filters for smoothing sets of data, acoustic barriers, blurring of images, and so on.

In some embodiments, the device 100 may include a micro transformer 37 that may be configured to boost the signal generated by a pickup device 35. Generally, a micro transformer 37 may comprise a static electrical device that transfers electrical energy between two or more circuits through electromagnetic induction while also being relatively small in size. In further embodiments, the device 100 may include additional sound modification hardware components which may be configured to modify the signal generated by a pickup device 35, such as tone and volume potentiometers or any type of component suitable for shaping, boosting or limiting the audio output signal generated by a pickup device 35. In preferred embodiments, the local interface 32 may run from the sound device 19 directly to the micro transformer 37 and then to the audio connector 22.

In some embodiments, the device 100 may comprise one or more audio connectors 22 which may be in communication with a sound device 19. An audio connector 22 may be positioned anywhere on the device 100, such as by being coupled within a connector aperture 29 disposed in a sidewall 14, 15, 16, 17. In preferred embodiments, an audio connector 22 may comprise a 0.25 inch phone jack connector which may enable a user to plug an instrument into the audio connector 22 and run the line to a sound board or other amplification device. In other embodiments, an audio connector 22 may comprise a male XLR cable connector, 3.5 mm stereo phone connector, a 2.5 mm phone connector, a 6.35 mm phone connector, a USB type connector such as a USB Type-C connector, a Lightning plug connector, or any other type of connector suitable for communicating an audio output signal to a sound reproducing device.

Electrical communication between one or more electrical components 19, 22, 35, 36, 37, may be provided by a local interface 32. In preferred embodiments, a local interface 32 may comprise standard electrical wiring. In other embodiments, a local interface 32 may comprise a printed circuit board (PCB) which mechanically supports and electrically connects electronic components using conductive tracks, pads and other features etched from copper sheets laminated onto a non-conductive substrate. PCBs can be single sided (one copper layer), double sided (two copper layers) or multi-layer. Conductors on different layers may be connected with plated-through holes called vias. In some embodiments, a circuit board may only comprise copper connections and no embedded components and may be called a printed wiring board (PWB) or etched wiring board. In other embodiments, a local interface 32 may comprise a printed circuit assembly (PCA), printed circuit board assembly or PCB assembly (PCBA), a circuit card assembly (CCA), or a backplane assembly, or any other suitable electrical connection and communication method.

In some embodiments, the device 100 may comprise one or more kerfs, such as a central kerf 23 and an alternating kerf 25, which may be disposed anywhere on one or more elements of the device 100. In preferred embodiments, a kerf 23, 25, may comprise a channel formed by removing material from an element so as to form a depression in the surface of the element that may or may not extend completely through the element.

In some embodiments, the device 100 may comprise a central kerf 23 which may be centrally positioned or disposed on the exterior surface 24 of the top plate 12. In further embodiments, the device 100 may comprise a central kerf 23 which may be centrally positioned or disposed on the exterior surface 24 of the top plate 12 and which may pass or extend through the top plate 12 to the interior surface 26. In other embodiments, the device 100 may comprise one or more central kerfs 23 which may be positioned anywhere on the exterior surface 24 and/or interior surface 26 of the top plate 12. A central kerf 23 may be configured with a width of approximately 0.0625 inches and a depth of approximately 0.50 inches, for example if the top plate 12 comprises a width of approximately 0.50 inches, although any other depths and widths may be used. In preferred embodiments, the device 100 may comprise a central kerf 23 having a length dimension (LD) of between approximately 6 inches and 22 inches. In further preferred embodiments, a central kerf 23 may have a length that is approximately between 20 to 99 percent of the longest length dimension of the exterior surface 24. In still further preferred embodiments, the length dimension of a central kerf 23 may be aligned with a central aperture 23 as best shown in FIG. 1.

Preferably, a central kerf 23 may be rip-cut (cuts made parallel to the wood grain) completely through the top plate 12 at approximately the mid-point of the top plate 12 so that when a performer or user is standing on the top plate 12, the performer's alternating or inactive (supporting) foot may not dampen the resonance of the top plate 12 when they are standing on and playing the device 100. This specific design element addresses an object of the invention allowing the performer to stand on the device 100 with both feet and is a key design feature of this foot actuated percussion device 100. Further, rip-cuts are preferred as they may not affect the structural integrity of the top plate 12 to the extent of cross-cuts.

In some embodiments, the device 100 may comprise one or more alternating kerfs 25 which may be positioned anywhere on the interior surface 26 and/or exterior surface 24 of the top plate 12 and which preferably may not extend completely through the top plate 12. An alternating kerf 25 may be configured with a depth of approximately 0.125 inches and a width of approximately 0.25 inches to 0.5 inches, although any other depths and widths may be used. Preferably, two or more alternating kerfs 25 may be rip-cut (cuts made parallel to the wood grain) in the interior surface 26 of the top plate 12 to increase resonance when the top plate 12 is struck by a user.

Figure 2:
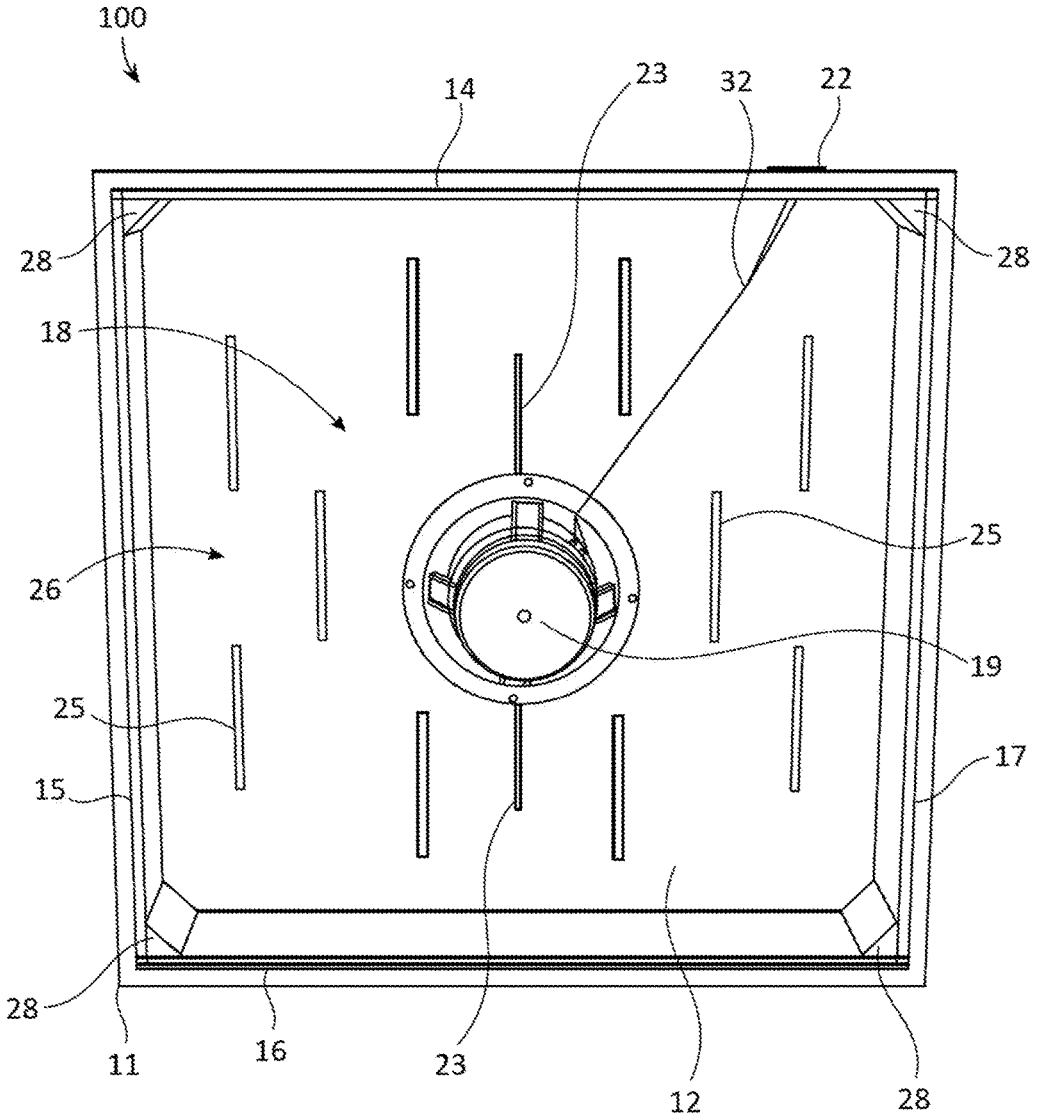
FIG. 2 illustrates a bottom perspective view of an example of a stomp box percussion device according to various embodiments described herein.
Figure 3:
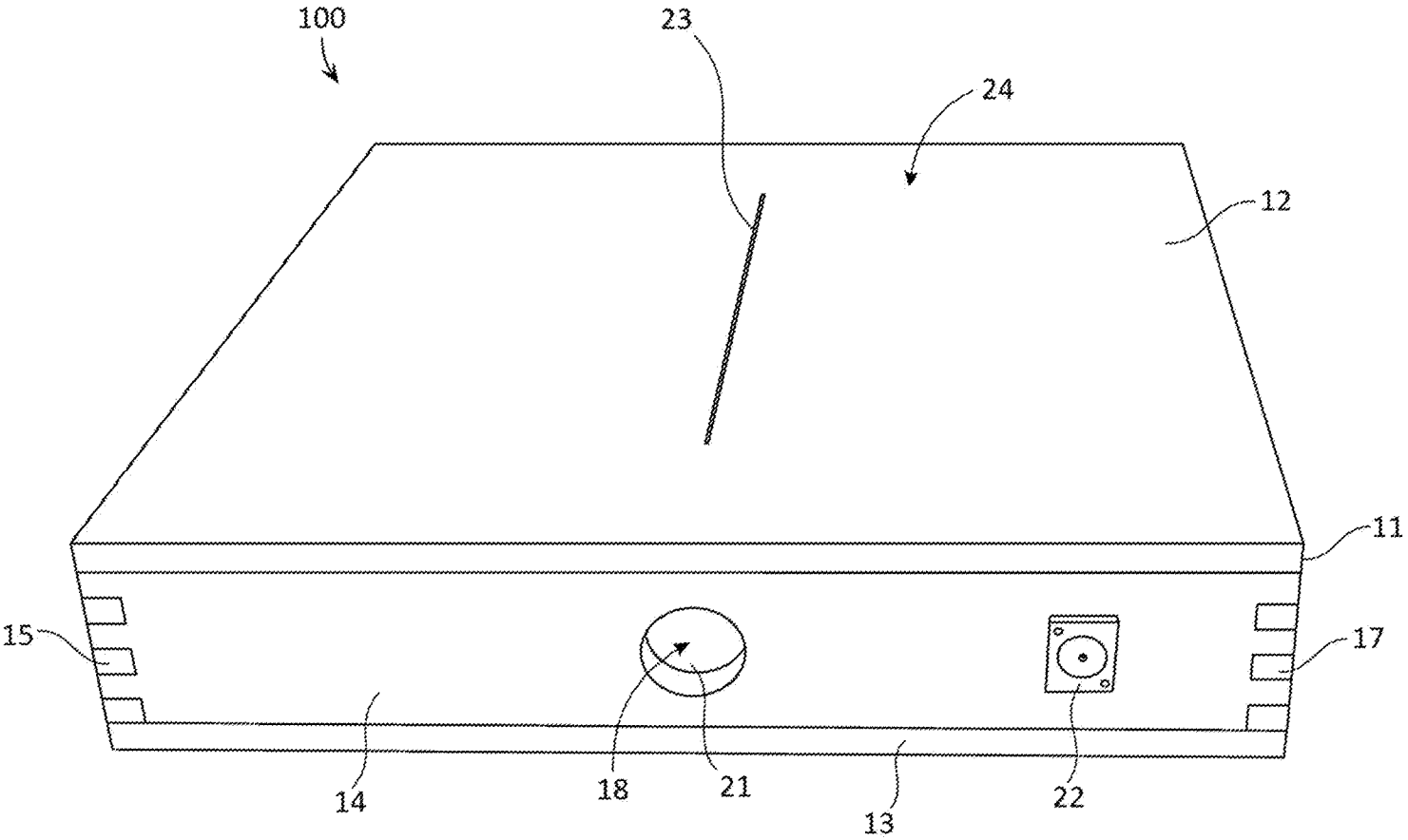
FIG. 3 shows a top perspective view of another example of a stomp box percussion device according to various embodiments described herein.
Figure 4:
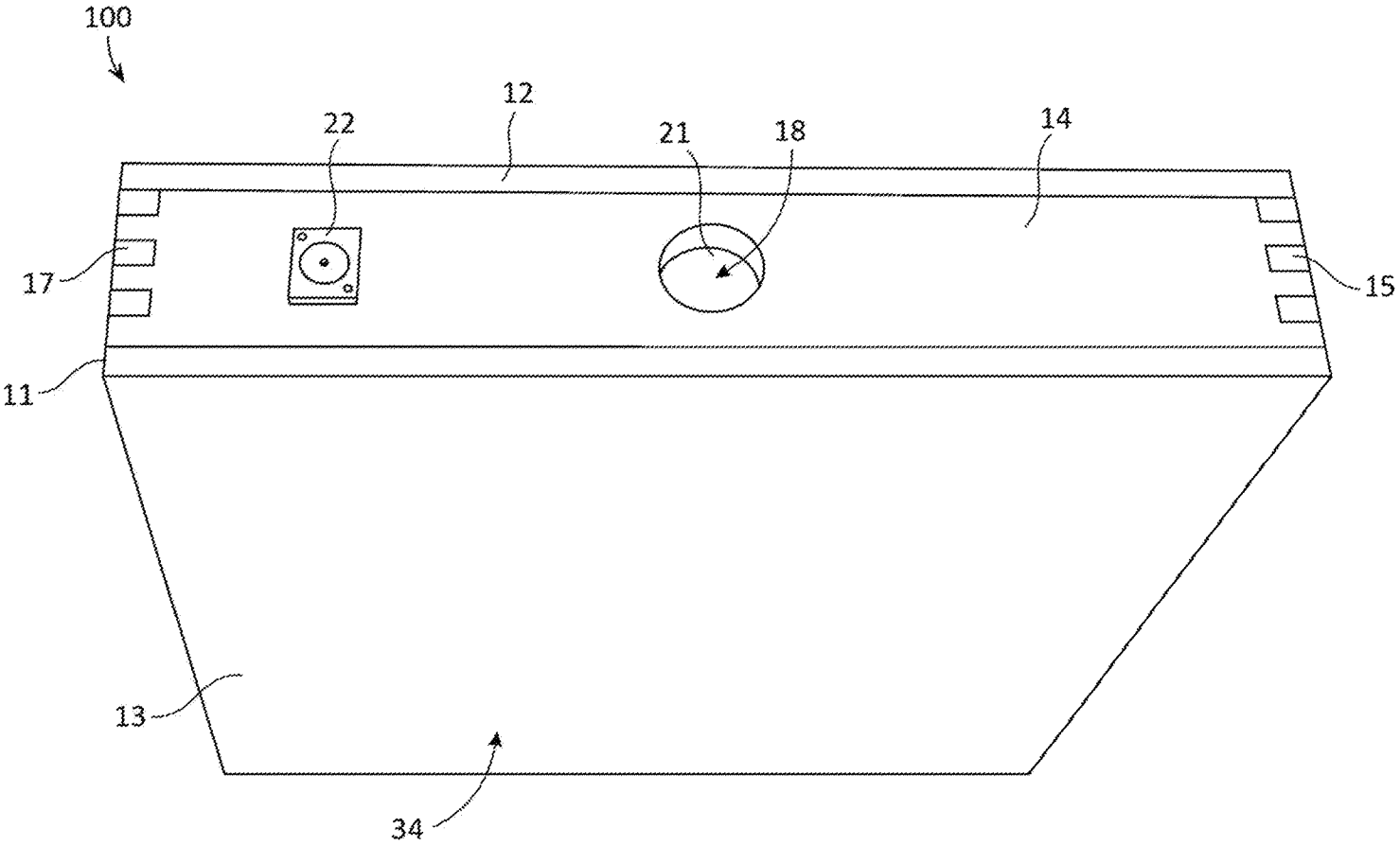
FIG. 4 depicts a bottom perspective view of another example of a stomp box percussion device to various embodiments described herein.
Figure 5:
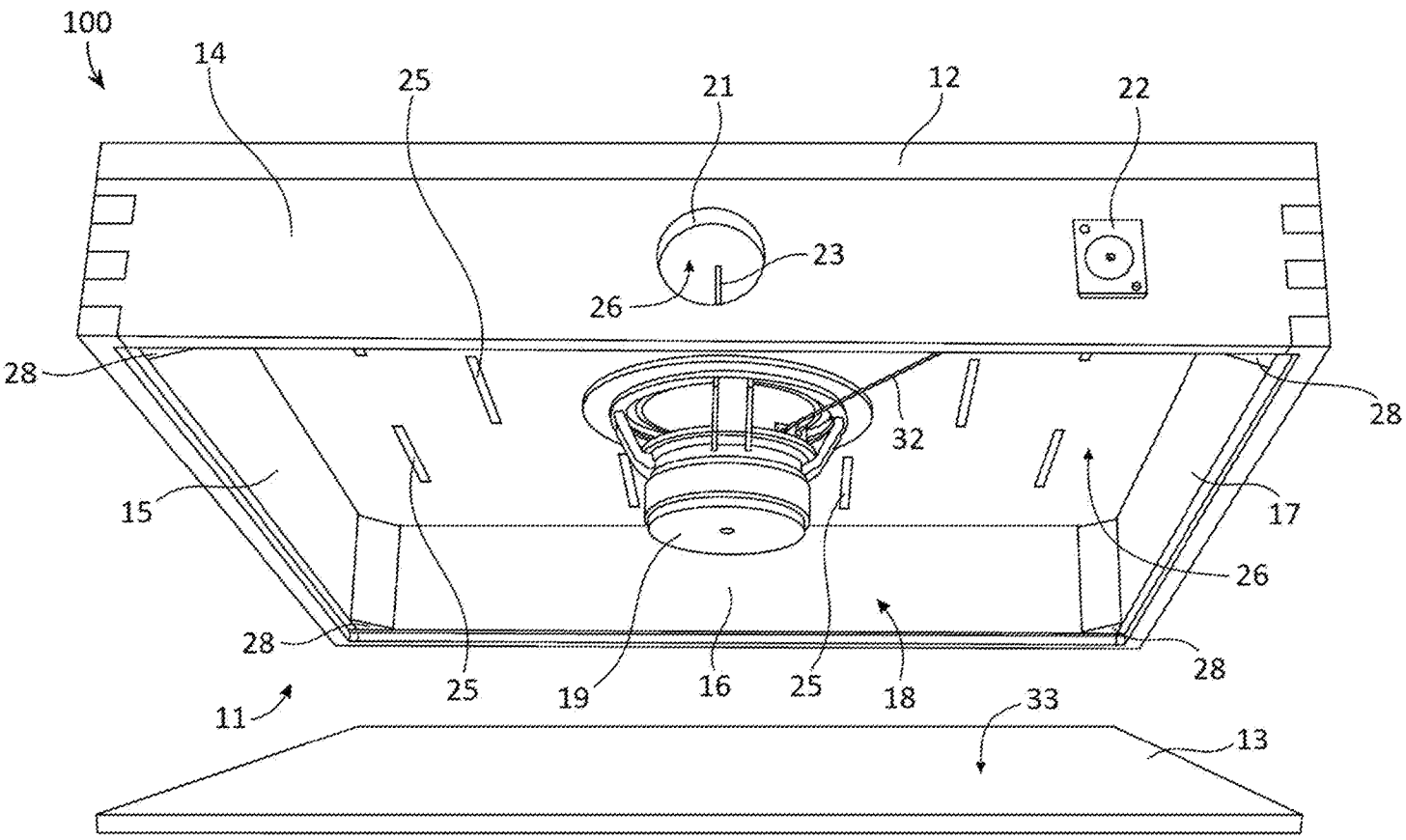
FIG. 5 illustrates a bottom perspective view of another example of a stomp box percussion device with a bottom plate separated from the other elements of the device according to various embodiments described herein.
Figure 6:
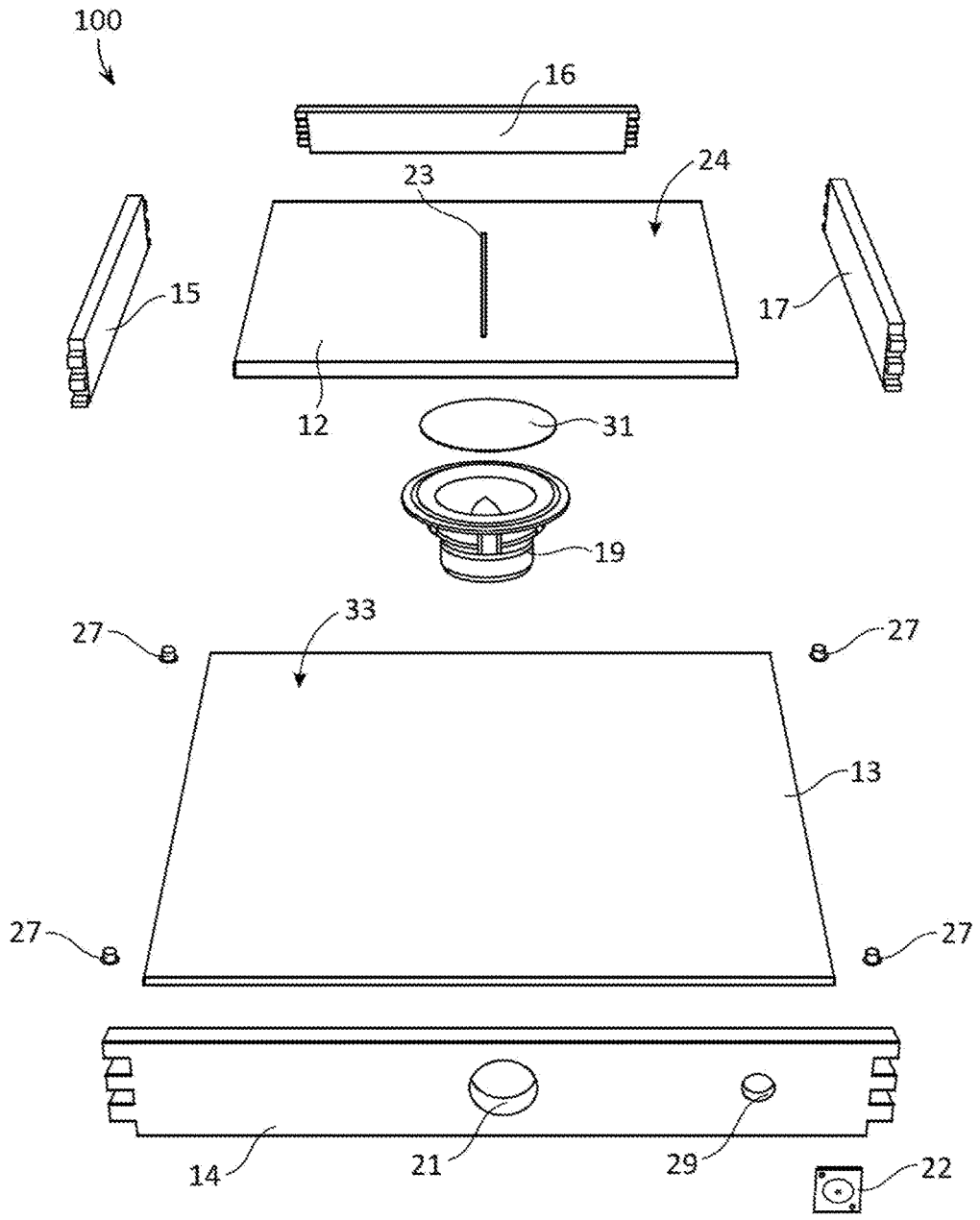
FIG. 6 shows a perspective exploded view of another example of a stomp box percussion device according to various embodiments described herein.
Figure 7:
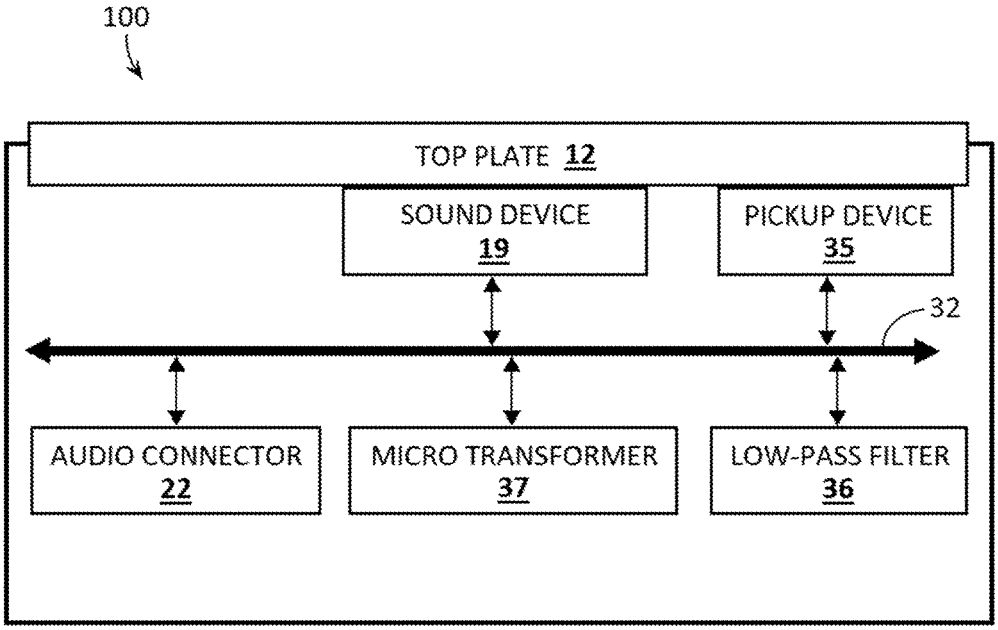
FIG. 7 depicts a block diagram of some exemplary components of a stomp box percussion device according to various embodiments described herein.

In some embodiments, the device 100 may comprise one or more central apertures 21 which may be configured with any shape or size and which may be positioned on one or more elements of the device 100. A central aperture 21 may pass through an element of the device 100, such as through a sidewall 14, 15, 16, 17, to balance the air resonance with the frequency of the top plate 12 in accordance with Helmholtz resonance calculation. In preferred embodiments, a central kerf 23 and a central aperture 21 may be generally aligned with each other as perhaps best shown in FIG. 1. In some embodiments, a central aperture 21 may be configured with a circular or cylindrical shape as shown in FIGS. 1, 2, and 4. In other embodiments, a central aperture 21 may be configured with any other shape and size.

While some materials have been provided, in other embodiments, the elements that comprise the device 100 such as the top plate 12, bottom plate 13, one or more sidewalls 14, 15, 16, 17, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A stomp box percussion device, the device comprising:
- a top plate having an exterior surface and an opposing interior surface;
- at least one sidewall, the sidewall coupled to the interior surface;
- a chamber formed by the interior surface and the at least one sidewall;
- a sound device disposed in the chamber;
- a central kerf disposed on the exterior surface of the top plate; and
- an alternating kerf disposed on the interior surface of the top plate.

2. The device of claim 1, further comprising a bottom plate.

3. The device of claim 1, wherein the sound device is coupled to the top plate.

4. The device of claim 1, comprising a first sidewall, a second sidewall, a third sidewall, and a fourth sidewall, and wherein the first sidewall, second sidewall, third sidewall, and fourth sidewall are each coupled to the interior surface.

5. The device of claim 4, wherein the chamber comprises a rectangular prism shape.

6. The device of claim 1, wherein the exterior surface is planar in shape.

7. The device of claim 1, further comprising a central aperture.

8. The device of claim 1, further comprising a support foot.

9. The device of claim 1, wherein the central kerf is centrally disposed on the exterior surface.

10. The device of claim 1, further comprising an audio connector.

11. The device of claim 1, further comprising a pickup device.

12. A stomp box percussion device, the device comprising:
- a top plate having an exterior surface and an opposing interior surface;
- at least one sidewall, the sidewall coupled to the interior surface;
- a bottom plate coupled to the at least one sidewall;
- a chamber formed by the interior surface, the at least one sidewall, and the bottom plate;
- a central aperture;
- a sound device disposed in the chamber;

a central kerf disposed on the exterior surface of the top plate; and an alternating kerf disposed on the interior surface of the top plate.

13. The device of claim 12, wherein the sound device is coupled to the top plate.

14. The device of claim 12, comprising a first sidewall, a second sidewall, a third sidewall, and a fourth sidewall, and wherein the first sidewall, second sidewall, third sidewall, and fourth sidewall are each coupled to the interior surface.

15. The device of claim 12, wherein the chamber comprises a rectangular prism shape.

16. The device of claim 12, wherein the exterior surface is planar in shape.

17. The device of claim 12, further comprising a support foot.

18. The device of claim 12, further comprising an audio connector.

19. The device of claim 12, further comprising a pickup device.

20. The device of claim 12, wherein the central kerf is centrally disposed on the exterior surface.

* * * * *